US007452642B2

(12) United States Patent
Tong et al.

(10) Patent No.: US 7,452,642 B2
(45) Date of Patent: Nov. 18, 2008

(54) HOLE TRANSPORTATION POLYMERS FOR PHOTORECEPTOR DEVICES

(75) Inventors: Yuhua Tong, Webster, NY (US); John F. Yanus, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 395 days.

(21) Appl. No.: 11/145,146

(22) Filed: Jun. 3, 2005

(65) Prior Publication Data

US 2006/0275682 A1 Dec. 7, 2006

(51) Int. Cl.
*G03G 5/047* (2006.01)
*G03G 5/147* (2006.01)

(52) U.S. Cl. ..... 430/58.7; 430/60

(58) Field of Classification Search ..... 430/58.7, 430/60

See application file for complete search history.

(56) References Cited

U.S. PATENT DOCUMENTS 4,298,697 A 11/1981 Baczek et al.
4,338,390 A 7/1982 Lu
4,560,635 A 12/1985 Hoffend et al.
4,587,189 A 5/1986 Hor et al.
5,019,473 A 5/1991 Nguyen et al.
5,418,107 A 5/1995 Nealey et al.
6,875,548 B2 4/2005 Tong et al.
2005/0069357 A1 * 3/2005 Kabata et al. ..... 399/351

* cited by examiner

*Primary Examiner*—Hoa V Le
(74) *Attorney, Agent, or Firm*—Eugene O. Palazzo; Fay Sharpe LLP

(57) ABSTRACT

Hole transport polymers are disclosed. The polymers include modified triarylamine groups attached to a polymeric material such as, for example, poly(vinyl butyral). The polymers are particularly suited for use in multilayered photoreceptors. The polymers can be readily synthesized. Also disclosed are photoreceptors containing one or more layers that include the noted polymers.

8 Claims, 1 Drawing Sheet

HOLE TRANSPORTATION POLYMERS FOR PHOTORECEPTOR DEVICES

INCORPORATION BY REFERENCE

The entire disclosures of U.S. Pat. Nos. 5,418,107; 5,019,473; and 4,587,189 are incorporated herein by reference.

BACKGROUND

The present disclosure relates, in various exemplary embodiments to certain hole transport polymers and their synthesis. The hole transport polymers have improved anti-deletion, charge mobility and mechanical properties that can be used in an overcoat composition for long life photoreceptors.

In the art of electrophotography, an electrophotographic imaging member or plate comprising a photoconductive insulating layer on a conductive layer is imaged by first uniformly electrostatically charging the surface of the photoconductive insulating layer. The plate is then exposed to a pattern of activating electromagnetic radiation, for example light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles, for example from a developer composition, on the surface of the photoconductive insulating layer. The resulting visible toner image can be transferred to a suitable receiving member such as paper. This imaging process may be repeated many times with reusable photosensitive members.

Electrophotographic imaging members are usually multi-layered photoreceptors that comprise a substrate support, an electrically conductive layer, an optional hole blocking layer, an optional adhesive layer, a charge generating layer, a charge transport layer, and an optional protective or overcoating layer(s). The imaging members can take several forms, including flexible belts, rigid drums, etc. For most multilayered flexible photoreceptor belts, an anti-curl layer is usually employed on the back side of the substrate support, opposite to the side carrying the electrically active layers, to achieve the desired photoreceptor flatness.

One type of multi-layered photoreceptor that has been employed as a belt in electrophotographic imaging systems comprises a substrate, a conductive layer, a charge blocking layer, a charge generating (photogenerating) layer, and a charge transport layer. The charge transport layer often comprises an activating small molecule dispersed or dissolved in a polymeric film forming binder. Generally, the polymeric film forming binder in the transport layer is electrically inactive by itself and becomes electrically active when it contains the activating molecule. The expression "electrically active" means that the material is capable of supporting the injection of photogenerated charge carriers from the material in the charge generating layer and is capable of allowing the transport of these charge carriers through the electrically active layer in order to discharge a surface charge on the active layer. The multi-layered type of photoreceptor may also comprise additional layers such as an anti-curl backing layer, required when layers possess different coefficient of thermal expansion values, an adhesive layer, and an overcoating layer. Commercial high quality photoreceptors have been produced which utilize an anti-curl coating.

Imaging members are generally exposed to repetitive electrophotographic cycling which subjects exposed layers of imaging devices to abrasion, chemical attack, heat and multiple exposure to light. This repetitive cycling leads to a gradual deterioration in the mechanical and electrical characteristics of the exposed layers. For example, repetitive cycling has adverse effects on exposed portions of the imaging member. Attempts have been made to overcome these problems. However, the solution of one problem often leads to additional problems.

Cracks developed in the charge transport layer during cycling are a frequent phenomenon and most problematic because they can manifest themselves as print-out defects which adversely affect copy quality. Charge transport layer cracking has a serious impact on the versatility of a photoreceptor and reduces its practical value for automatic electrophotographic copiers, duplicators and printers.

Another problem encountered with electrophotographic imaging members is corona species induced deletion in print due to oxidation of the charge transport molecules by chemical reaction with corona species. During electrophotographic charging, corona species are generated. Corona species include, for example ozone, nitrogen oxides, acids and the like.

Other problems affecting the performance of the imaging member include lateral charge migration and stress cracking in the photoreceptor. The concentration of charge transport molecules in the charge transport layer is a known factor affecting the degree of lateral charge migration. In particular, higher concentrations of charge transport molecules near the surface of the charge transport layer tend to result in a higher degree of lateral charge migration and more stress cracks.

In electrophotographic photoreceptor devices having a hole transport layer, the layer usually comprises hole transport triarylamine small molecules dispersed in polymeric binders. Because these small molecules are prone to crystallization in machine operating conditions, this crystallization induced phase separation of the hole transport layer could easily lead to the failure of the whole device. Accordingly, it is advantageous to maintain the hole transport layer amorphous. Appropriate selection and synthesis of polymer hole transport material is one method available to solve this problem. But, the synthesis of hole transport polymers normally requires proper catalysts and produces non-volatile side products. The purification of these catalyst and side-products is often very difficult. To date, few polymer hole transport materials have been successfully used in photoreceptor products. Accordingly, there is a need to identify hole transport polymers that promote future long life photoreceptor devices, and methods for the preparation of such hole transport polymers.

BRIEF DESCRIPTION

The present disclosure, in various exemplary embodiments thereof, relates to a method for forming a polymeric hole transport material having triarylamine groups. The method comprises, for example, providing a methylphenyl amino benzaldehyde. The method also comprises providing Meldrum's acid derivatives. The method additionally comprises reacting effective amounts of the methylphenyl amino benzaldehyde and Meldrum's acid derivatives to produce a grafted Meldrum-triarylamine intermediate. The method also comprises providing a hydroxylated polymer. And, the method comprises reacting effective amounts of the grafted Meldrum-triarylamine intermediate and the hydroxylated polymer to thereby produce a polymeric hole transport material comprising triarylamine groups. The exemplary embodiment includes the resulting polymeric hole transport material.

In another aspect, the present disclosure relates, in exemplary embodiments thereof, to a method for forming a polymeric hole transport material having triarylamine groups. The method comprises providing Meldrum's acid derivatives and a triarylamine entity. The method also comprises reacting effective amounts of Meldrum's acid derivatives and the triarylamine entity to produce a Meldrum-triarylamine intermediate. The method also comprises providing a hydroxyethyl methacrylate. And, the method comprises reacting effective amounts of the Meldrum-triarylamine intermediate and the hydroxyethyl methacrylate to thereby produce a polymeric hydroxyethyl methacrylate having triarylamine groups. The exemplary embodiment includes the resulting hole transport material.

Additionally, the present disclosure, in various exemplary embodiments thereof, relates to a photoreceptor comprising a substrate and a charge generating layer disposed on the substrate. The photoreceptor also comprises a hole transport layer disposed on the charge generating layer. The hole transport layer includes a polymeric hole transport material having triarylamine groups. The hole transport material is one or both of (i) poly(vinyl butyral) having triarylamine groups, and (ii) hydroxyethyl methacrylate having triarylamine groups.

Further, the present disclosure relates, in various embodiments thereof, to a photoreceptor comprising a substrate; a charge generating layer disposed on the substrate; a hole transport layer disposed on the charge generating layer; and optionally an overcoat layer disposed on the hole transport layer, at least one of the hole transport layer and optional overcoat layer including a polymeric hole transport material comprising a modified triarylamine attached to a polymer material.

These and other non-limiting characteristics and features of the development are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
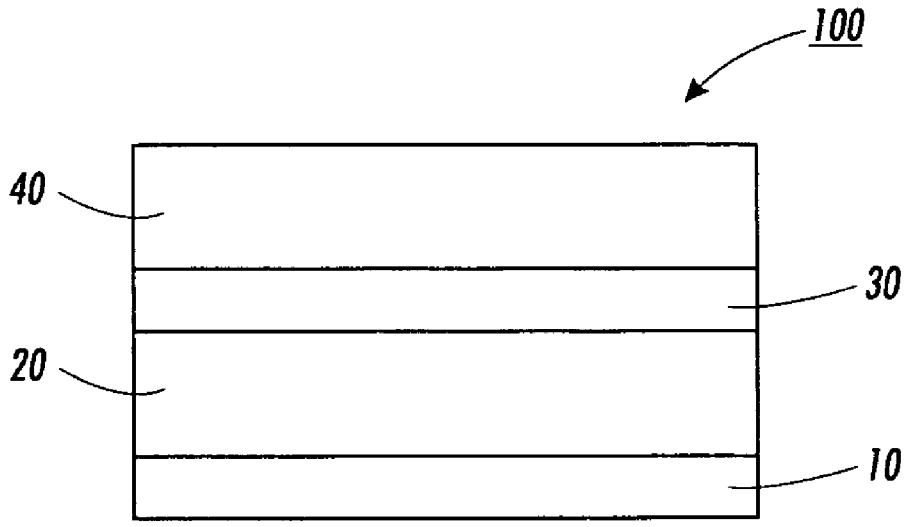
FIG. 1 is a schematic illustration of an exemplary embodiment multilayered photoreceptor.

The exemplary embodiment provides polymeric hole transporters with anti-deletion capabilities, high charge carrying mobility and excellent mechanical properties. These polymers can be used as an overcoat layer, particularly for economic reasons, but is not restricted as such. The exemplary embodiment also provides a method for the production of these polymers, layers including such polymers, and imaging members utilizing such layers.

Also included within the scope of the present disclosure are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697; and, 4,338,390, the disclosures of which are totally incorporated herein by reference, subsequently transferring the image to a suitable substrate, and permanently affixing the image thereto.

A more complete understanding of the processes and apparatuses disclosed herein can be obtained by reference to the accompanying drawings. These figures are merely schematic representations based on convenience and the ease of demonstrating the present development, and are, therefore, not intended to indicate relative size and dimensions of the imaging devices-or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to component of like function.

FIG. 1 illustrates an exemplary embodiment layered photoreceptor device 100 including a layer of the noted polymeric hole transport material. The device 100 comprises a substrate 10 upon which is disposed a charge generating layer 20, an optional intermediate layer 30, and a charge or hole transport layer 40, as described herein. The hole transport layer 40 comprises the exemplary embodiment hole transport polymer. It will be appreciated that the exemplary embodiment photoreceptor 100 can include other layers or components not depicted in FIG. 1.

The substrate may be opaque or substantially transparent and may comprise numerous suitable materials having the required mechanical properties. Accordingly, this substrate may comprise a layer of an electrically non-conductive or conductive material such as an inorganic or an organic composition. As electrically non-conducting materials there may be employed various thermoplastic and thermoset resins known for this purpose including polyesters, polycarbonates, polyamides, polyurethanes, and the like or metals such as aluminum, nickel, steel, stainless steel, titanium, chromium, copper, Indium tin oxide, tin, and the like. The substrate may have any suitable shape such as, for example, a flexible web, rigid cylinder, sheet and the like. Preferably, the substrate support is in the form of an endless flexible belt.

The thickness of a flexible substrate support depends on numerous factors, including economical considerations, and thus this layer for a flexible belt may be of substantial thickness, for example, over 200 micrometers, or of minimum thickness less than 50 micrometers, provided there are no adverse affects on the final photoconductive device. In one flexible belt embodiment, the thickness of this layer ranges from about 65 micrometers to about 150 micrometers, and preferably from about 75 micrometers to about 125 micrometers for optimum flexibility and minimum stretch when cycled around small diameter rollers, e.g. 12 millimeter diameter rollers.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be from about 20 angstroms to about 750 angstroms, and more preferably from about 100 angstroms to about 200 angstroms for an optimum combination of electrical conductivity, flexibility, and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer may be utilized and such adhesive layer materials are well known in the art. Typical adhesive layer materials include, for example, polyesters, polyurethanes, and the like. Satisfactory results may be achieved with adhesive layer thickness from about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying, and the like.

At least one electrophotographic imaging layer is formed on the adhesive layer, blocking layer, or substrate. The electrophotographic imaging layer may be a single layer that performs both charge generating and charge transport functions, as is well known in the art, or it may comprise multiple layers such as a charge generator layer and charge transport layer. Charge generator (also referred to as photogenerating) layers may comprise amorphous films of selenium and alloys of selenium and arsenic, tellurium, germanium and the like, hydrogenated amorphous silicon and compounds of silicon and germanium, carbon, oxygen, nitrogen, and the like fabricated by vacuum evaporation or deposition. The charge generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakisazos; and the like dispersed in a film forming polymeric binder and fabricated by solvent coating techniques. Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene bisimide pigments; indigo pigments such as indigo, thioindigo, and the like; bisbenzoimidazole pigments such as Indofast Orange toner, and the like; phthalocyanine pigments such as titanyl phthalocyanine, aluminochlorophthalocyanine, hydroxygalliumphthalocyanine, and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. Alloys of selenium are encompassed by embodiments of the disclosure and include for instance selenium-arsenic, selenium-tellurium-arsenic, and selenium-tellurium.

A charge generating layer of the exemplary embodiment photoreceptor can comprise a perylene or a phthalocyanine pigment applied either as a thin vacuum sublimation deposited layer or as a solution coated layer containing the pigment dispersed in a film forming resin binder. For photoreceptors utilizing a perylene charge generating layer, the perylene pigment is preferably benzimidazole perylene which is also referred to as bis(benzimidazole). This pigment exists in the cis and trans forms.

Benzimidazole perylene is ground into fine particles having an average particle size of less than about 1 micrometer and dispersed in a preferred polycarbonate film forming binder of poly(4,4'-diphenyl-1,1'-cyclohexane carbonate). Optimum results are achieved with a pigment particle size from about 0.2 micrometer to about 0.3 micrometer. Benzimidazole perylene is described in U.S. Pat. No. 5,019,473 and U.S. Pat. No. 4,587,189.

Although photoreceptor embodiments prepared with a charge generating layer comprising benzimidazole perylene dispersed in various types of resin binders give reasonably good results, the photoreceptor benzimidazole perylene dispersed in poly(4,4'-diphenyl-1,1'-cyclohexane carbonate) is also useful.

Particularly, the film forming polycarbonate binder for the charge generating layer has a molecular weight from about 20,000 to about 80,000. Satisfactory results may be achieved when the dried charge generating layer contains from about 20 percent to about 90 percent by volume benzimidazole perylene dispersed in poly(4,4'-diphenyl-1,1'-cyclohexane carbonate) based on the total volume of the dried charge generating layer. Preferably, the perylene pigment is present in an amount from about 30 percent to about 80 percent by volume. Optimum results are achieved with an amount from about 35 percent to about 45 percent by volume. The use of poly(4,4'-diphenyl-1,1'-cyclohexane carbonate) as the charge generating binder is preferred, because it allows a reduction in perylene pigment loading without an extreme loss in photosensitivity.

Any suitable organic solvent may be utilized to dissolve the polycarbonate binder. Typical solvents include tetrahydrofuran, toluene, methylene chloride, and the like. Tetrahydrofuran is preferred because it has no discernible adverse effects on xerography and has an optimum boiling point to allow adequate drying of the generator layer during a typical slot coating process. Coating dispersions for charge generating layer may be formed by any suitable technique using, for example, attritors, ball mills, Dynomills, paint shakers, homogenizers, microfluidizers, and the like.

Any suitable coating technique may be used to apply coatings. Typical coating techniques include slot coating, gravure coating, roll coating, spray coating, spring wound bar coating, dip coating, draw bar coating, reverse roll coating, and the like.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is from about 5 micrometers to about 100 micrometers, but thicknesses outside this range can also be used. A dried thickness of from about 18 micrometers to about 35 micrometers is preferred with optimum results being achieved with a thickness from about 24 micrometers to about 29 micrometers.

The charge transport layer can comprise an arylamine small molecule dissolved or molecularly dispersed in a polycarbonate.

In embodiments, the charge transport layer comprises a polymeric hole transport material in accordance with the present disclosure, which includes a modified triarylamines grafted to a polymer material. The exemplary embodiment provides a strategy in which hole transport materials, such as triarylamine are reacted to generate an aldehyde functional group. The aldehyde groups can then be subsequently coupled with Meldrum's acid to form a reactive intermediate. This reactive intermediate (Meldrum's acid attached triarylamine) can easily polymerize with diols or any polymers containing hydroxyl groups to produce exemplary embodiment hole transporting polymers under mild conditions without catalysts. Meldrum's acid is also known as 2,2-dimethyl-1,3-dioxane4,6-dione cyclic isopropylidene malonate. The only side products of this reaction are carbon dioxide, water and acetone, hence no further purification is needed after the polymerization. For example, di(4-methylphenyl)phenylamine attached with Meldrum's acid can react with the remaining hydroxyl groups in poly(vinyl butyral) (PVB) to produce PVB with tritolylamine groups. The photoreceptor devices with this hole transport polymer exhibited excellent electrical properties.

The expression "polyvinyl butyral", as employed herein, is defined as a copolymer of terpolymer obtained from the hydrolysis of polyvinyl acetate to form polyvinyl alcohol or a copolymer of polyvinyl alcohol with residual vinyl acetate groups, the resulting polyvinyl alcohol polymer being reacted with butyraldehyde under acidic conditions to form polyvinyl butyral polymers with various amounts of acetate, alcohol and butyraldehyde ketal groups. These polyvinyl butyral polymers are commercially available from, for example, Solutia Inc. under the trade designations BMS, BLS, BLI, B79, B99, and the like. These polymers differ in the amount of acetate, hydroxyl, and butyraldehyde ketal groups contained therein. Generally, the weight average molecular weights of polyvinyl butyral film forming polymers vary from about 36000 to about 98000. Particularly, the weight average molecular weight of the polyvinyl butyral utilized in the exemplary embodiment process is from about 40,000 to about 250,000. This polymer is described in U.S. Pat. No. 5,418,107.

In one exemplary embodiment synthesis, a more deletion resistant tritolylamine (TTA) is incorporated into the hydroxylated polymer PVB (polyvinyl butyral) to form hole transport polymer. The synthesis involves first forming a compound of Meldrum acid attached to a hole transport moiety (through aldehyde) and then reacting this compound with hydroxyl groups in the polymer, such as PVB. The synthesis has several advantages over known approaches of preparing hole transport polymers, such as but not limited to no non-volatile byproducts, and no catalyst purification. Used as an overcoat on a photoreceptor device, the PVB-TTA hole transport polymer exhibits improved resistance against solvent induced cracking and lateral charge migration (LCM) deletion, and has good stability over the course of 10,000 cycles.

Other layers such as conventional ground strips comprising, for example, conductive particles disposed in a film forming binder may be applied to one edge of the photoreceptor in contact with the zirconium and/or titanium layer, blocking layer, adhesive layer or charge generating layer.

Optionally, an overcoat layer may also be utilized to improve resistance to abrasion. In some cases a back coating may be applied to the side opposite the photoreceptor to provide flatness and/or abrasion resistance. These overcoating and backcoating layers may comprise organic polymers or inorganic polymers that are electrically insulating or slightly semi-conductive.

Figure 2:
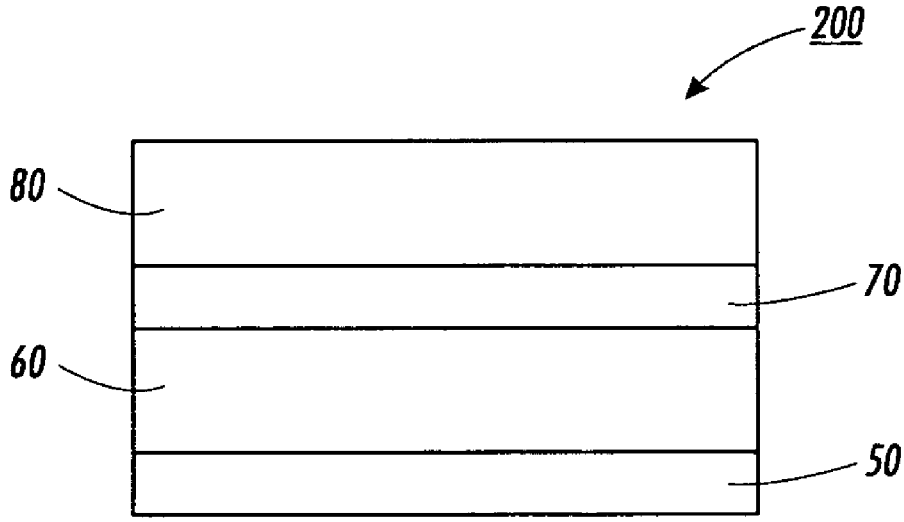
FIG. 2 is a schematic illustration of another exemplary embodiment multilayered photoreceptor.

In still other embodiments, a hole transport polymer in accordance with the present disclosure may be used as an overcoat layer. With reference to FIG. 2, a photoreceptor 200 comprises a substrate 50, a charge generator layer 60, a charge transport layer 70, and an overcoat 80, the overcoat 80 comprising a polymer having a modified triarylamines attached thereto.

The charge transport layer 70 may include any suitable charge transport material. Any suitable charge transport layer may be utilized. The active charge transport layer may comprise any suitable transparent organic polymer of non-polymeric material capable of supporting the injection of photogenerated holes and electrons from the charge generating layer and allowing the transport of these holes or electrons through the organic layer to selectively discharge the surface charge. The charge transport layer in conjunction with the generation layer is a material which is an insulator to the extent that an electrostatic charge placed on the transport layer is not conducted in the absence of illumination Thus, the active charge transport layer is a substantially non-photoconductive material which supports the injection of photogenerated holes from the generation layer.

The charge transport layer forming mixture generally comprises an aromatic amine compound. Typical aromatic amine compounds include triphenyl amines, bis and poly triarylamines, bis arylamine ethers, bis alkylarylamines and the like.

Any suitable inactive resin binder soluble in methylene chloride or other suitable solvent may be employed in the exemplary embodiment. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000.

The hole transport polymers as described herein having a modified triarylamines attached to a polymer may be applied as a layer of a photoreceptor by any suitable technique as described herein with reference to the other layers of a photoreceptor.

A hole transport polymer in accordance with the present disclosure and photoreceptors comprising the same are further described with reference to the following examples. The examples are presented merely for the purpose of further describing the present exemplary embodiments and not for the purpose of limiting the same.

EXAMPLES

A series of trials were conducted to further assess the benefits and characteristics of the exemplary embodiments described herein. In a first exemplary embodiment synthesis, a methylphenyl amino benzaldehyde is reacted with Meldrum's acid to produce a grafted Meldrum-TTA. The Meldrum-TTA is reacted with PVB, to yield a PVB-TTA material. In the following synthesis, all materials were used as received. The synthesis route is illustrated below:

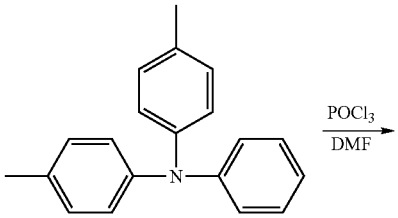

-continued

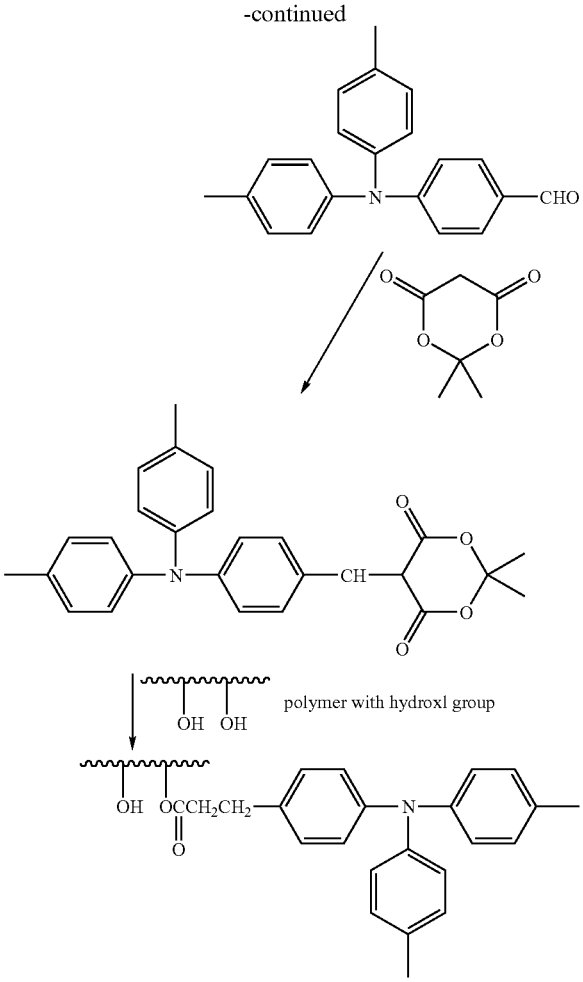

4-[N,N-di-(4-methylphenyl)amino]benzaldehyde [DMAB]: N,N-di(4-methylphenyl)phenylamine 54.6 grams was dissolved in 1,2-dichloroethane 120 ml and dimethylformamide [DMF] 29.2 grams at 5° C. With stirring, phosphorus oxychloride 36.7 g was added dropwise into the solution. After the addition, the solution was stirred at 5° C. for 30 minutes, then transferred to 70° C. oil bath and stirred for 15 hours under argon gas flow. 1,2-dichloroethane was then vaporized off under reduced pressure. After ambient cooling to 24° C., the solution was poured into 500 grams of ice. The precipitate was collected by filtration, washed by 3×200 ml of water, dried at 50° C. in a vacuum oven. The slight green product, 57 grams was obtained, with yield 94.7%.

2,2-dimethyl-1,3-dioxane-5-(4-(N,N-di-(4-methylphenyl) amino)benzyl)-4,6-dione [Meldrum-TTA]: The above product DMAB 32.0 grams and Meldrum's acid 17.3 grams were dissolved in methylene chloride 150 ml at 5° C. 2,2-dimethyl-1,3-dioxane-4,6-dione (Meldrum's acid) was purchased from Aldrich Chemicals. Dry pyridine 20.4 ml was added into the solution slowly with magnetic stirring. After the addition, the solution was kept at 5° C. for 2 hours, and then stirred at room temperature for 15 hours. This solution was cooled again to 5° C., and 40 grams of acetic acid was added into the solution gradually. Then, sodium borohydride 11.4 grams was added into the stirred solution portion by portion to keep the solution temperature under 25° C. The solution was stirred at room temperature for 15 hours, then 200 grams of ice and 100 ml of methylene chloride were added. The organic layer was collected by separation funnel, washed by 3×200 ml of water, and then dried over anhydrous sodium sulfate 30 grams. After filtration, the solution was condensed to about 80 ml, and 300 ml of methanol was added. The solution was kept in a refrigerator overnight. The slightly yellowish crystals were collected by filtration, and dried in a vacuum oven. The product 34 grams was obtained with yield 74.5%. The chemical structure was confirmed by NMR and MS.

Poly(vinyl butyral) grafted by Meldrum-TTA [PVB-TTA]: Poly(vinyl butyral) Pioloform® BN-18 (from Wacker Specialties) 2.89 grams and Meldrum-TTA 4.29 grams were dissolved in tetrahydrofuran 80 gams. The solution was heated in a 80° C. oil bath for 15 hours under argon gas flow. After the reaction, the solution was poured into 300 ml of water with stirring. The pale yellowish precipitate was collected. Because the side products were water, $CO_2$ and acetone, the precipitated product was very clean, no further purification was necessary. This product was dried at 70° C. for 18 hours. NMR and FT-IR confirmed the grafting reaction was quantitative.

In another exemplary embodiment synthesis, another hole transport polymer, a hydroxyethyl methacrylate Meldrum-TTA, can be formed. In this strategy, Meldrum-TTA, obtained as previously described, is reacted with a hydroxyethyl methacrylate.

Synthesis of Poly(2-hydroxyethyl methacrylate-g-Meldrum-TTA):

In a 100-ml flask, Meldrum-TTA 2.15 grams and 2-hydroxyethyl methacrylate 0.65 gram were dissolved in 30 ml of toluene. Under argon gas flowing, 0.0065 gram of free radical initiator benzoyl peroxide was added. The solution was heated to reflex of toluene for 6 hours. Then, toluene was evaporated off, and the remained colorless solid was washed by 100 ml of methanol, and was dried under vacuum. The final product was a kind of white powder about 1.8 grams. GPC measured Mw about 47800 and Mn about 33000.

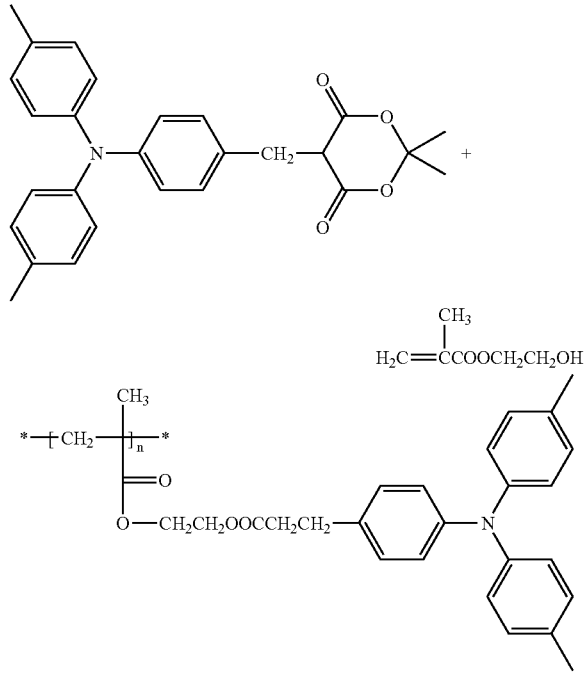

An exemplary embodiment coating solution was prepared as follows. 1.0 gram of PVB-TTA polymer was dissolved in 9.0 grams of tetrahydrofuran. A clear solution was obtained after 1.5 hour, and this solution was ready for coating as overcoat.

The above PVB-TTA solution was coated by #1 Bird bar applicator on a standard photoreceptor device which was prepared by the same method described in U.S. Pat. No.6, 875,548, and dried at 110° C. for 30 minutes. The thickness of the overcoat was about 3 microns. This new photoreceptor device was designated as device No. 1.

The new photoreceptor device, device No. 1, and a standard photoreceptor device were tested for-electrical properties according to the method described in U.S. Pat. No. 6,875, 548. The results are summarized in Table 1.

TABLE 1

| | PIDC Electrical Properties | | | | | | | |
|---|---|---|---|---|---|---|---|---|
| Sample | $V_0$ | S | Vc | Vr | $V_{(E=6.0.)}$ | $V_{depl}$ | $V_{dd}$ | $V_{cyc-up}$ |
| | | | First Cycling | | | | | |
| Standard Photo-receptor | 797 | 370.2 | 165.6 | 49.9 | 67.9 | 26.2 | 39.3 | 25.8 |
| Device No. 1 | 797 | 297.8 | 160.0 | 17.8 | 41.8 | 0.1 | 56.5 | 11.4 |
| | | | After 10k cycling | | | | | |
| Standard Photo-receptor | 798 | 360.5 | 214.5 | 67.1 | 97.3 | 35.2 | 38.9 | |
| Device No. 1 | 801 | 273.3 | 168.5 | 2.7 | 34.0 | 1.4 | 79.5 | |

In Table 1, V0 is the dark voltage after scorotron charging; S is the initial slope of the PIDC, which is a measurement of sensitivity; Vc is the surface potential at which PIDC slope is S/2; Vr is the residual voltage; $V(_{E=6.0})$ is the average voltage after exposure to 6.0 erg/cm$^2$; $V_{depl}$ is the difference between applied voltage and V0; $V_{dd}$ is 0.2 s duration dark decay voltage; $V_{cyc-up}$ is the residual change after 10000 cycling test From the above data, it is evident that the electrical performance of this new photoreceptor device with the noted polymer overcoat is very good. The initial tests for solvent induced cracking and deletion showed the new device was much better than a standard photoreceptor not having the noted polymer overcoat. This is because the new PVB-TTA polymer is amorphous, and the grafted TTA imparts better anti-oxidation properties. This new hole transport polymer PVB-TTA can be easily made and purified.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A photoreceptor comprising:

a substrate;

a charge generating layer disposed on the substrate;

a hole transport layer disposed on the charge generating layer, the hole transport layer including a polymeric hole transport material having tritolylamine groups, the material selected from the group consisting of (i) poly (vinyl butyral) having tritolylamine groups, (ii) hydroxylethyl methacrylate having tritolylamine groups, and combinations thereof.

2. The photoreceptor of claim 1 wherein the hole transport layer includes poly(vinyl butyral) having tritolylamine groups.

3. The photoreceptor of claim 1 wherein the hole transport layer includes hydroxyethyl methacrylate having tritolylamine groups.

4. The photoreceptor of claim 3 wherein the hydroxyethyl methacrylate having tritolylamine groups is poly(2-hydroxyethyl methacrylate-g-Meldrum-TTA).

5. A photoreceptor comprising:

a substrate;

a charge generating layer disposed on the substrate;

a hole transport layer disposed on the charge generating layer; and an optional overcoat layer disposed on the hole transport layer;

wherein the hole transport layer includes a polymeric hole transport material made by the process of:

providing a triarylamine having an aldehyde functional group;

providing Meldrum's acid;

reacting effective amounts of the triarylamine with the Meldrum's acid to form a reactive intermediate;

providing a polymer containing hydroxyl groups;

reacting effective amounts of the reactive intermediate and the polymer containing hydroxyl groups to produce the polymeric hole transport material.

6. The photoreceptor of claim 5, wherein the photoreceptor comprises an overcoat layer and the overcoat layer comprises the polymeric hole transport material.

7. The photoreceptor of claim 5, wherein the polymeric hole transport material is selected from the group consisting of (i) poly(vinyl butyral) having tritolylamine groups attached thereto, (ii) hydroxyethyl methacrylate having tritolylamine groups attached thereto, and combinations thereof.

8. The photoreceptor of claim 5, wherein the triarylamine having an aldehyde functional group is 4-[N,N-di-(4-methylphenyl)amino]benzaldehyde [DMAB].

* * * * *